US005632441A

United States Patent [19]

Toval

[11] Patent Number: 5,632,441

[45] Date of Patent: May 27, 1997

[54] ELEVATING MAILBOX

[76] Inventor: Ferdinand A. Toval, 2001 E. Terra Vista Way, Sandy, Utah 84093

[21] Appl. No.: 613,689

[22] Filed: Mar. 11, 1996

[51] Int. Cl.[6] ..... B65D 91/00

[52] U.S. Cl. ..... 232/17

[58] Field of Search ..... 232/17, 38, 28; 52/111

[56] References Cited

U.S. PATENT DOCUMENTS

| | | | |
|---|---|---|---|
| 2,189,486 | 2/1940 | D'Amico | 52/111 X |
| 3,214,156 | 10/1965 | Klose et al. | 52/111 X |
| 3,593,914 | 7/1971 | Van Orden | 232/17 |
| 4,114,801 | 9/1978 | Van Orden | 232/17 |

*Primary Examiner*—Kenneth J. Dorner
*Assistant Examiner*—Jerry Redman
*Attorney, Agent, or Firm*—M. Reid Russell

[57] ABSTRACT

An elevating mailbox consisting of a housing that is open therethrough and is closed across a top end by a cap, with the housing to telescope into and out of a ground sleeve that is seated in a hole in the ground adjacent to a road way, and providing a sealing arrangement for discouraging water entry into the ground sleeve. The housing includes a mail receiving cavity that is exposed when the housing is in an elevated attitude. A screw jack is maintained to a bottom of the ground sleeve to extend and retract a screw from a nut arranged across a cylinder when the screw is turned, with a screw top end journaled to the housing to lift and lower the housing, with the screw arranged to be turned by operation of an electric motor that is operated by a remote control connected through wires to operate at set times and on demand, and including limit switches for turning off motor operation at upper and lower limits of housing travel into and out of the ground sleeve.

10 Claims, 3 Drawing Sheets

ELEVATING MAILBOX

BACKGROUND OF THE INVENTION

1. Field of the Invention

The present invention relates to mailboxes, and particularly to rural mailboxes located at curbside that are protected from damage by being movable to an exposed attitude only when a mail delivery is eminent.

2. Prior Art

Historically rural mailboxes mounted to posts alongside a road that receive a mail delivery from a mail truck have been very vulnerable to damage and destruction by persons, usually teenagers, who strike the mailbox with sticks and bats, even from moving vehicle, who place explosive devices in such mailbox, and who perform like destructive mischief. Accordingly, mailbox replacement has been and will likely to remain a thriving business. Over the years law enforcement has seemed to be unable to stem this destruction as, apparently, a very low priority is placed on such crimes as compared to other offenses. Accordingly, the rural homeowner has been powerless to thwart this destruction, until the present invention.

The invention provides for maintaining a mailbox out of harms way during times when damage is likely to occur, particularly at night, and moves the mailbox to an attitude to receive mail only when a mail delivery is eminent, usually at mid-day, when there is less likelihood of persons trying to damage the mailbox. Specifically, the invention provides for a timed elevation of a mailbox from a recessed attitude in a storage hole formed in the ground when a mail delivery is eminent, and automatically lowers the mailbox back into its storage hole at the end of a time period where mail delivery is eminent.

Heretofore, where a property owner has desired to thwart damage and destruction of their mailbox, they have often resorted to mounting a conventional mailbox in a stone or brick pillar, have resorted to purchasing and mounting thick steel mailbox and post systems, and the like. To the knowledge of the inventor, however, none have implemented a movable arrangement that is like that of the invention that provides for mechanically automatically moving a mailing receiving box from an attitude where it is inaccessible, to an accessible attitude, to remain thereat during a time period where mail is delivered, and to then automatically lower, returning the mailbox to its stowed attitude, all under the control of a timer.

SUMMARY OF THE INVENTION

It is a principal object of the present invention in an elevating mailbox to provide a mail receiving box maintained to an automated elevator mechanism to elevate out of and retract back into a below ground installation under the control of a timer circuit, the mail receiving box to emerge and remain in an erected attitude over a time period where mail is delivered, and will retract below ground to remain protected against vandalism.

Another object of the present invention in an elevating mailbox is to provide a motor driven mechanical system for lifting and lowering a platform maintaining a mail receiving box thereon from and back into a below ground location on command of a timer circuit.

Another object of the present invention in an elevating mailbox is to provide a screw jack as the mechanical system that is turned to lift and lower a platform supporting the mail receiving box and including limit switches to stop platform travel at the limits of screw jack travel.

Another object of the present invention in an elevating mailbox is to provide a timer arrangement for commanding operation of an electric motor to turn the screw jack to raise and lower the platform at set times, and including a capability for remote control of the electric motor operation for overriding the timer to command system operation.

Still another object of the present invention in an elevating mailbox is to provide a cap system for mounting to the top of the mailbox maintained above ground that is arranged to provide a water seal to a top lip or edge of a below ground container and includes an overhang for directing water away from the ground container, preventing water from seeping therein.

Still another object of the present invention in an elevating mailbox is to provide a drain system for the ground container for draining, into the ground below the container, any water as may collect therein.

Still another object of the present invention in an elevating mailbox is to provide a simple and reliable elevating mailbox system for below ground installation in a prepare hole that is adjacent to a roadway to elevate to receive mail and retract back into its stowed attitude to protect the mailbox system from vandalism.

The present invention is in a mailbox system that is preferably for below ground installation to elevate to receive mail, as for a rural area during hours of likely mail delivery, and to retract to a stowed below ground attitude protected against vandalism until a next time of mail deliver. The system includes a housing for positioning in a below ground sleeve that is preferably a rectangular steel box that is closed across its bottom end and is arranged for anchoring in the hole but may be constructed by digging a hole and fitting preformed panels therein that are seal at their junctions, or can be a poured concrete box. The ground sleeve is connected, preferably through an underground cable, to a source of electrical power and to a remote control station that is preferably located in the system owner's home.

A platform supporting a mail receiving container is maintained across an upper or top end of a screw that includes a pulley secured thereto. The screw is turned through a nut maintained across a top end of a cylinder whose lower end is mounted to extend at a right angle from the box bottom. So arranged, turning of the pulley turns the screw into or out of the nut raising or lowering the connected platform that is joumaled so as not to turn with the turning screw or pulley. The pulley is connected through a belt to a drive pulley that is secured across an output shaft of a drive motor that, in turn, is mounted to extend from a wall of the housing that is to telescope into and extend out from the ground sleeve. With the housing mounting the mail receiving container across its top end and is open across its bottom end. So arranged, with turning of the pulley that extends or retract the screw, the motor pulley and the screw pulley will remain aligned.

The motor preferably receives electrical power through a timer circuit that may be mounted to the motor side and is preferably controlled by a remote keypad, or, may, for some operations, be radio operated. Additional to the platform mounting the mail receiving container, a bracket is secured to the platform undersurface, to extend alongside the screw, and mounts an upward travel limit switch having switch that is spring biased upwardly and aligns with a pivot arm whose free end is attached to one end of a tether. The tether, in turn, is guided through a pipe that connects to a lower brace end that, in turn, connects to the base of the screw support. So arranged, as the motor is operated to turn The screw through the belt and pulleys, the platform and connected components, including the bracket and the upward travel limit switch, whereto the tether end is secured are moved upwardly, pulling the tether to where it is stretched tight and pulls against a spring biasing. The arm is thereby pulled into engagement with the upward travel limit switch arm, with contact therebetween to disconnect power to the motor at the platform limit upward of travel. To limit platform downward travel, a downward travel limit switch arm is connected to a plate that is, in turn, secured to a bracket that connects also to the motor, with a switch arm thereof to engage a contact plate that is secured to extend outwardly from the cylinder. So arranged, as the platform and motor are lowered, the downward travel limit switch arm will engage, at the platform lower limit of travel, the contact plate, flexing the switch arm upwardly to disconnect power to the motor.

The ground sleeve includes a collar secured to its top end and that slopes downwardly to an outer edge whose undersurface engages and fits into a recess in the ground. The collar, adjacent to an opening therethrough that the housing slides, includes a sealing lip that is for engaging an undersurface of a cap that is secured across the mail box top, for sealing against water entry. The cap is sloped downwardly from the center thereof for shedding water. Additionally, for draining water as should enter the ground sleeve, a drain is preferably provided in the ground sleeve bottom that opens into a sump, or the invention may include a sump pump for pumping collected water out of the ground sleeve bottom.

BRIEF DESCRIPTION OF THE DRAWINGS

These and other objects and features of the present invention will become more apparent from the following description in which the invention is described in detail in conjunction with the accompanying drawings.

DETAILED DESCRIPTION

Figure 1:
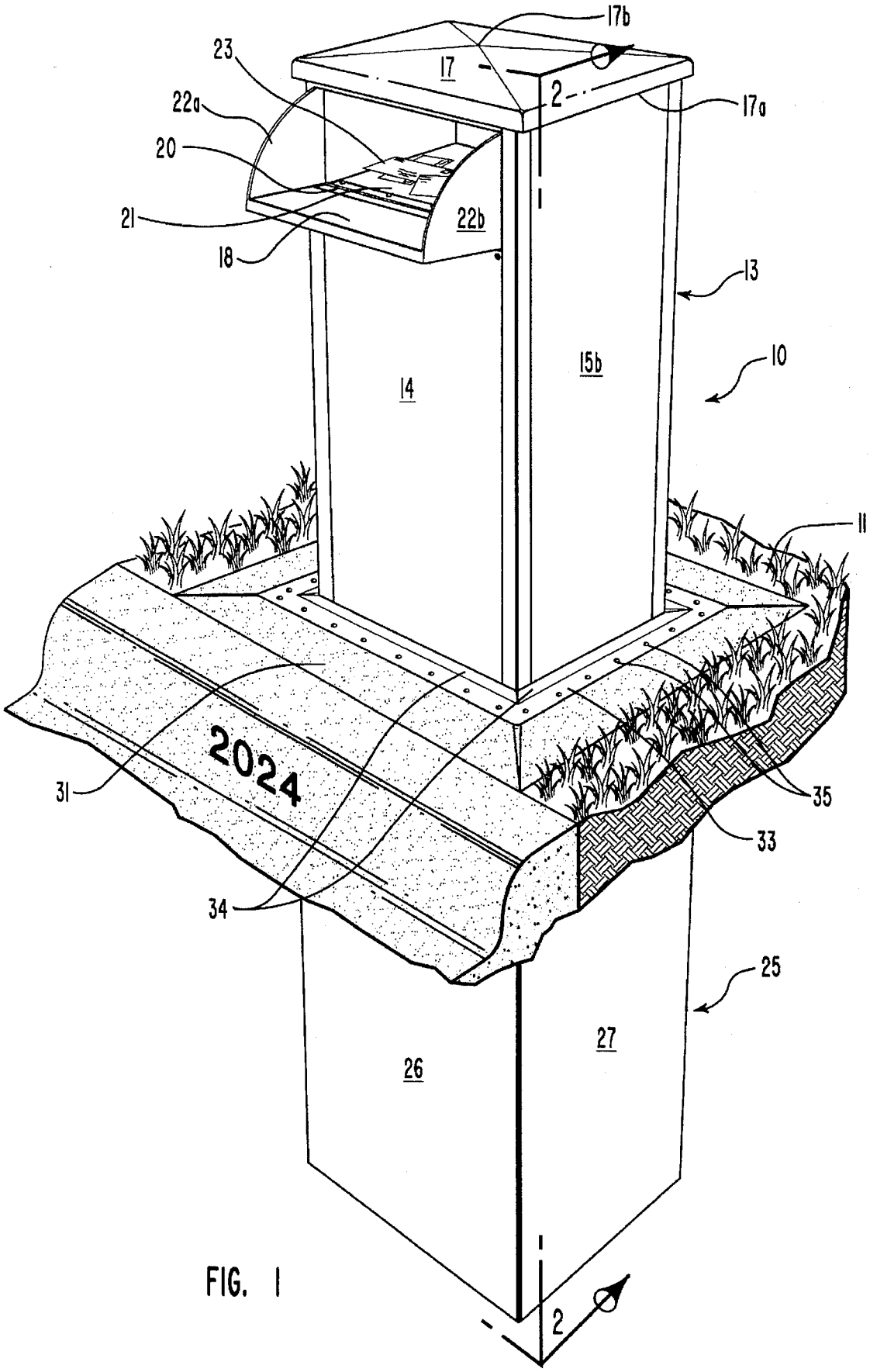
FIG. 1 is a side elevation perspective view of the invention in an elevating mail box shown mounted in the ground adjacent to a roadway gutter, with a housing thereof elevated to an erected attitude.

FIG. 1 shows a side elevation perspective view of an elevating mail box 10 of the invention mounted in a hole 12 formed into ground 11. The mail box 10 includes a housing 13, shown as rectangular sleeve, that consists of flat front, side and back walls, 14, 15*a*, 15*b* and 16, respectively, that connect at fight angles along their edges into a rectangular box that is open across a lower end and includes a cap 17 fitted across the top end. A transverse plate 21 is connected across the rectangular box, spaced apart from the box top end to form a mail receiving container that is closed across a forward end by a rectangular cover plate 18. The rectangular cover plate is connected to the transverse plate 21 by a hinge 20, that is preferably a piano type hinge. So arranged, an operator, such as a mail carrier, can fit their fingers in a lateral slot 19 formed in the cover plate 18, proximate to a top edge, and can then pull that cover plate towards them, to the attitude shown in FIG. 1. With the cover plate at approximately a fight angle to the housing front wall, the cover plate lower edge will engage the top edge of the front wall. In which cover plate travel, side arcuate side walls 22*a* and 22*b*, that connect along straight edges of each to the inner edges of the cover plate 18, pivot with the cover plate to form sides. The mail carrier guides mail 23 through the across the cover plate and onto the transverse plate 21, as shown. In practice, after passing mail 23 into the mail box 10, as shown in FIG. 1, the mail carrier closes the cover plate 18 by rotating it upwardly. Should, however, the mail carrier fail to dose the cover plate, when the mail box descends into the hole 12, as described below, the cover plate 18 will engage an edge portion 34 of an opening formed through a ground collar 31, and will thereby be pivoted upwardly around hinge 20 to the attitude shown in FIGS. 2 and 3.

Figure 2:
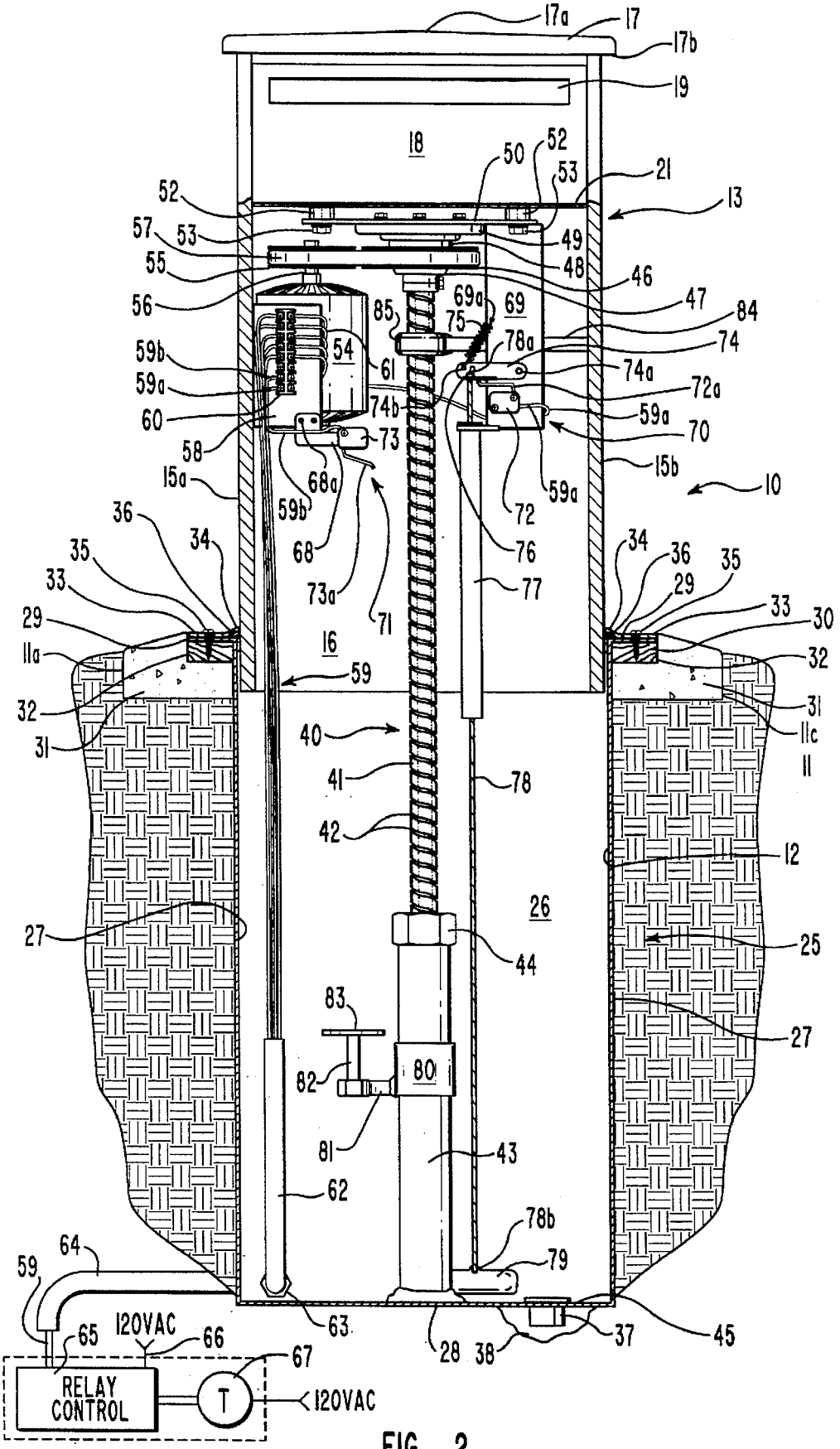
FIG. 2 is a side elevation sectional view taken along the line 2—2 of FIG. 1 showing the components of the elevating mail box.
Figure 3:
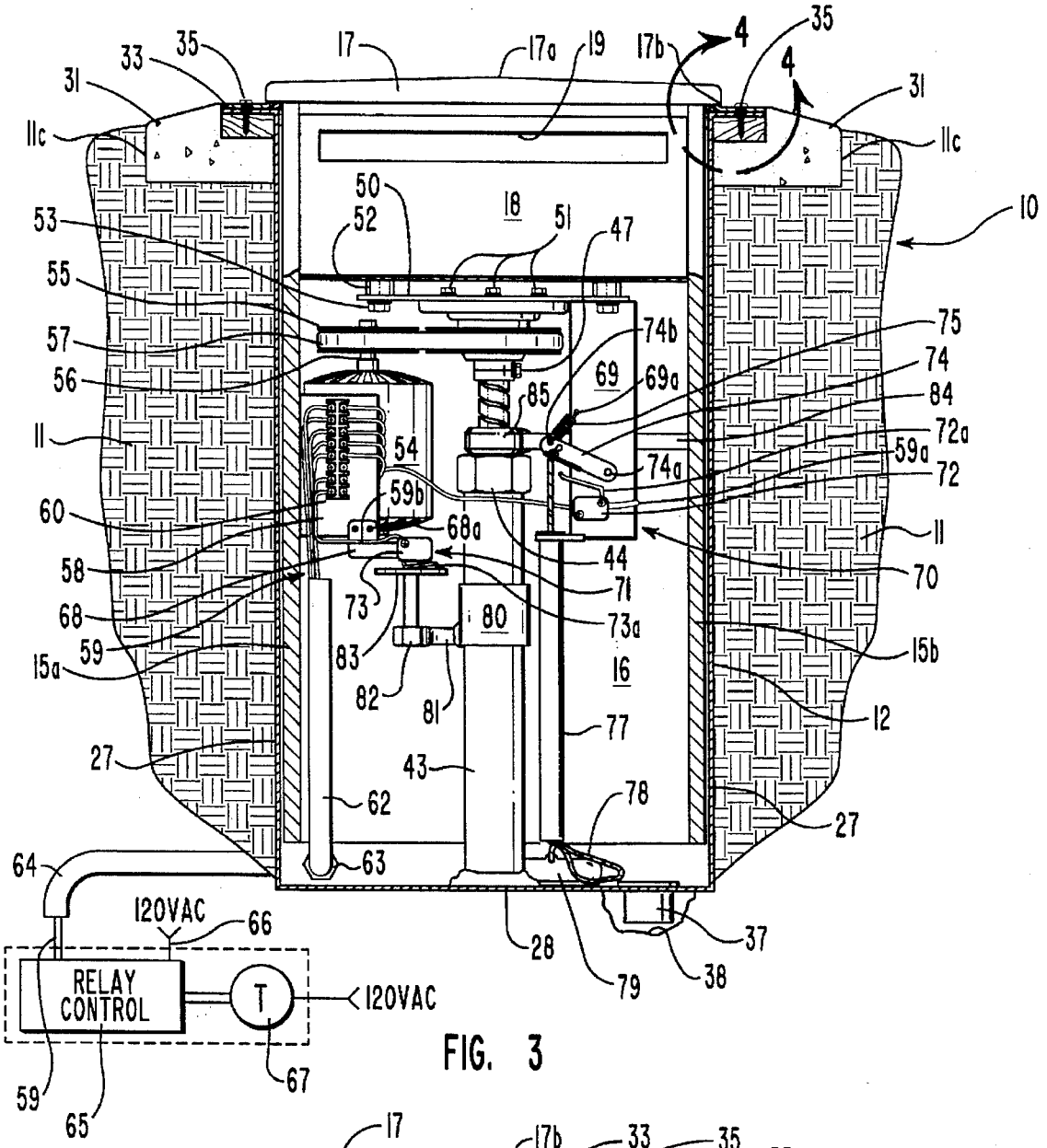
FIG. 3 is a side elevation sectional view like that of FIG. 2 only showing the elevating mail box as having been lowered into a ground sleeve, with a lower edge portion of a cap shown in sealing engagement with a collar that extends outwardly from the housing.

The mail box 10 is to telescope into a ground sleeve 25 that is constructed for installation in hole 12. The ground sleeve 25, as shown, includes identical front and rear walls 26 and side walls 27, that are joined into a rectangle that is open across a top end and is closed across a bottom 28, as shown in FIGS. 2 and 3. The ground sleeve includes a flange 29 that extends outwardly, as shown best in FIG. 4, from around the ground sleeve 25 top edge to engage and rest upon a coupling bar 30, shown herein as a section of wood, that is secured in a fight angle slot 32 formed in collar 31. The collar 31, as shown, is preferably formed of concrete and is to rest in a shelf 11*a* that has been formed into ground 11, around hole 12. A weather seal that consists of a plate 33 having a center opening wherethrough the ground sleeve 25 is fitted and includes an upturned inner edge portion 34 is provided to fit on top of the flanged 29. The inner edge portion 34 fits over flange 29 and aligns holes 35*a* and 29*a* therethrough that are to receive screws 35 turned into coupling bar 30 to connect the components.

Figure 4:
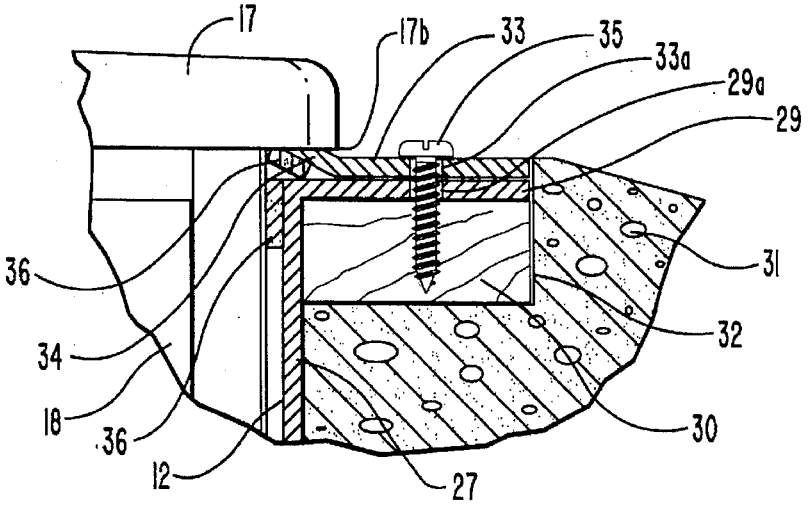
FIG. 4 is an enlarged sectional view taken within the line 4—4 of FIG. 3, showing the cap lower edge portion in sealing engagement with a collar seal.

As shown in FIG. 4, with the mail box lowered into the ground sleeve 25, an undersurface 17*b* of an eve of the cap 17 will engage a top edge of the plate upturned inner edge portion 34. Which engagement urges the bottom edge thereof into a gasket 36 for providing a water tight seal therebetween. Accordingly, with the mail box 10 in a stowed attitude, as shown in FIGS. 3 and 4, the contact of the cap eve undersurface 17*b* to the plate edge portion 34 will prohibit an entry of water into the ground sleeve 25. Additionally, to encourage water to flow off the cap 17, to travel off of the eve, the cap includes a center peak 17*a* wherefrom the cap top surface slopes uniformly downwardly to the cap eve. To discourage water from passing along the mail box 10 housing 13 walls when it is elevated, as shown in FIGS. 1 and 2, the plate 33 edge portion 34 and gasket 35 are closely proximate to the mail box housing 13 walls, presenting a minimum spacing distance for water to pass through. Accordingly, the combination of the cap overhanging eves, and the arrangement of plate 33 edge portion and gasket 35, discourage entry of water into the ground sleeve 25. Should however water enter therein, the invention preferably includes a drain 37 formed through the ground sleeve 25 bottom 28 to pass water therethrough into a sump 38 that is formed in the ground 11, in the bottom of hole 12, thereby maintaining the bottom 28 of ground sleeve 25 free of water.

As set out above, the mail box housing 13 is for telescoping out of and back into the ground sleeve 25, as shown in FIGS. 1 through 3. To provide this housing 13 travel, so as to expose the cover plate 18 and allow it to be opened to pass mail 23 therethrough and onto transverse plate 21, as shown in FIGS. 1 and 2, a screw jack 40 is provided, as shown in FIGS. 2 and 3. Shown therein the screw jack 40 includes a screw 41 that is a straight cylindrical shaft that has a wide thread 42 formed therein running the screw length. The screw 41 is turned through a nut 44 that is maintained across a top end of a straight sleeve 43. The straight sleeve 43 is open therethrough and has its lower end mounted through a foot 45 to the ground sleeve bottom 28, the straight sleeve thereby extending at a fight angle upwardly. So arranged, the screw 41, in the attitude shown in FIG. 3, is housed in the straight sleeve 43, with its top end extending through the nut 44 that is maintained across the straight sleeve top end, as shown in FIG. 2. The screw 41 will extend from and will retract back into the straight sleeve depending upon the direction that the screw is turned.

To provide screw 41 turning, a pulley 46 collar 47 is secured, as by a set screw mounting, not shown, onto a top screw end. The pulley 46 top, in turn, is fitted to the race of a bearing 48 that is connected at an outer portion to a flange 49 whereto is connected a mounting plate 50. This connection is provided by turning bolts 51 through holes, not shown, formed through the mounting plate 50, and into threaded holes, not shown, formed into flange 49. The mounting plate 50 is, in turn, connected to piers 52 that are secured to extend at fight angles downwardly from the undersurface of the transverse plate 21. Which connection is provided by turning bolts 53 through holes, not shown, that are formed through the mounting plate 50 and into longitudinal threaded holes, not shown, formed into the piers 52. So arranged, turning of the pulley 46 turns the screw 41 also into or out of the nut 44, depending upon direction of pulley turning. In which turning, the flange 49 that is mounted to the race of bearing 48 free wheels, with the screw 41 extension of retraction to move the flange 49 and ultimately the transverse plate 21, only up or down, moving also the mail box housing 13 that is connected thereto. The mail box is thereby elevated out of or is retracted into the ground sleeve 25, as described above.

Shown in FIGS. 2 and 3, an electric motor 54 is provided for turning a pulley 55 that is secured across an end of a motor output shaft 56. A continuous belt 57 is arranged over the pulleys 46 and 55, respectively, to turn the screw 41, as described above. The electric motor, as shown, is mounted to a bracket 58 that is, in turn, mounted to an inner surface of the housing side wall 15*a*, traveling up and down therewith. To provide for motor operation, electricity is transferred through wires 59, into and through a connector block 60 that is mounted onto bracket 58, and into motor control wires 61 that connect into the motor 54, to supply electricity thereto. Some of which wires 59, as shown, connect through a ground sleeve conduit 62 that is shown maintained through a connector 63 fitted through a ground sleeve wall that connects to an end of a supply conduit 64. So arranged, wires 59 passed therethrough connect to a relay control 65 that is grounded at 66 and connects to a source of electrical power 67, shown as a plug identified as 120 VAC, contained in a broken line box. The relay control 65 is preferably located remotely from the mail box 10, as in an owners home, to provide for remote programming and system operation. So arranged, command and control signals are routed through the relay control 65 as from an operator programming times of system operation and directing manual operation of the system. Further, wires 59*a* and 59*b* are connected into block 60 from, respectively, upper and lower limit switches 70 and 71, that, when operated as set out below, command motor cut off at, respectively, upper and lower limits of mail box housing 13 travel.

Upper limit switch 70 is provided to terminate motor 54 operation when the mail box 10 is in the attitude shown in FIG. 2, with lower limit switch 71 providing for shutting off motor 54 when the mail box 10 is in the attitude shown in FIG. 3. The limit switch 71 includes a body 73 that wire 59*b* connects into, and wherefrom a switch arm 73*a* extends. The body 73 is shown mounted to a plate 68 that connects, by screws 68*a*, through bracket holes into the bracket 58, with the switch arm 73*a* extending towards the bottom 28. The upper limit switch 70 is mounted to a lower end portion of a bracket 69 that connects to extend downwardly from the mounting plate 50, alongside of the screw 41. The limit switch 70 includes a body 72 that wire 59*a* connects into and wherefrom a switch arm 72*a* extends. As shown, the body 72 is mounted to the bracket 69 such that the switch arm 72*a* extends upwardly to engage, in the attitude shown in FIG. 2, a pivot bar 74. The pivot bar 74 is connected on one end, by a pivot 74*a*, to the bracket 69 and includes a right angle tab 76 that has a hole formed therethrough. The tab 76 hole receives an end of a cable 78 fitted therethrough that has a knot 78*a* tied in the cable end. So arranged, when the cable 78 is stretched tight, as shown in FIG. 2, the knot 78*a* end thereof will pull the pivot arm 74 downwardly, around the pivot 74*a*, to engage and depress the switch arm 72*a* to shut off of the motor 54. Operation of limit switch 70 is to stop the screw 41 from being turned out of the nut 44. To reset or open the limit switch 70, the switch arm 72 is disengaged from the pivot bar 74 and flexes away from the housing 72. To provide this disengagement, the pivot bar 74 includes, a hole 74*b* formed through its end opposite to pivot mount 74*a*, that receives one end of a coil spring 75 whose opposite end connects into a hole 69*a* formed through the bracket 69. The coil spring 75 thereby provides a spring biasing of the pivot bar 74 to urge it to the attitude shown in FIG. 3. This biasing is overcome and the pivot bar 74 pulled to the attitude shown in FIG. 2 to operate the limit switch 70 when the cable 78 is stretch tight. The cable 78, as shown, has its lower end 78*b* fitted through a hole formed through a bracket 79 and knotted. The bracket 79, as shown, is secured on one end to extend outwardly from the side of the bottom portion of the straight sleeve 43. So arranged, the length of the cable 78 between its end couplings to the pivot arm 74 and the bracket 79 controls the distance the housing 13 will telescope out of the ground sleeve 25. In operation, when the mail box 10 is in its stowed attitude, as shown in FIG. 3, the cable will be slack, coiling on the bottom 28. To avoid the cable interfering with screw 41 operation, or the like, the cable 78 is preferably fitted through a tube 77 that connects on a top end to the bracket 79. Which tube 77 provides for protecting the cable 78 during mail box operation.

As set out above, the lower limit switch 71 is connected through wire 59*b* to motor 54 to direct motor shut off when the mail box 10 is fully lowered into the ground sleeve 25. Like upper limit switch 70, the lower limit switch 71 is connected to move up and down with the housing 13, with the switch arm 73*a* thereof facing downwardly to engage and be depressed by contact with a horizontal plate 83, as shown in FIG. 3. The horizontal plate 83, as shown, is secured to a top end of a rod 82 whose lower end is maintained at a right angle to an arm 81. The arm 81, in turn, is secured to extend outwardly from a collar 80 that is mounted to the straight sleeve 43. The collar mounting to straight sleeve 43, as required, may be adjustable to provide for setting the mail box 10 cap 17 seating onto the flange 29, to provide a tight fit therebetween.

As set out above, the screw 41 of screw jack 40 is turned out or into the nut 44 to extend and retract between the attitudes shown in FIGS. 2 and 3. During extension, to guide screw 41 travel, a guide collar 85 is preferably maintained around the screw 41, proximate to its mounting to pulley 46. The guide collar 85 is connected to an end of a bar 84 that is, in turn, connected to extend at a fight angle from the housing 13 side 15*b*. The guide collar 85 is fitted around the screw 41 to allow it to turn freely therethrough, but will prohibit the screw 41 from tilting from the vertical.

The mail box 10 of the invention, as has been shown and described herein, provides a housing for telescoping, at set times or on command, out of a guide sleeve 25 that is maintained in a hole 12 formed in the ground, that is preferably adjacent to a roadway. The screw jack 40, as shown, is powered by electric motor 54 that is the preferred motive power source to lift and lower the mail box housing 13. It should, however, be understood the invention is not limited to the screw jack and the electric motor, as shown, and that other arrangements for elevating and lowering the mail box housing can be employed, within the scope of this disclosure. For example, another type of jack, such as a scissoring jack, a jack that extends a ram therefrom, such as a hydraulic jack, or the like, could be so employed, and that a power source other than an electric motor could be employed, as for example, a pneumatic or hydraulic source, or the like, within the scope of this disclosure. Further, the present invention is not limited to the limit switches 70 and 71, as are shown and described, and could employ another or other arrangements for limiting the mail box housing 13 extension or retraction, within the scope of this disclosure.

While a preferred embodiment of my invention in an elevating mail box has been shown and described herein, it should be understood the present disclosure is made by way of example only and that variations and changes are possible without departing from the subject matter and a reasonable equivalency thereof coming within the scope of the following claims, which claims I regard as my invention.

I claim:

1. An elevating mailbox comprising, a housing that is open therethrough and across a lower end with parallel sides and is capped across a top end, includes a mail receiving cavity arranged therein, adjacent to said top end, and is fitted with a ground sleeve; the ground sleeve that is open therethrough and across a top end, and is for receiving said housing telescoped therein, with said ground sleeve for installation in a hole, has parallel sides and is closed across a bottom end; a jack means mounted to said ground sleeve bottom including a screw means that is a straight threaded rod fitted for turning through a threaded nut means maintained to a cylinder means having a bottom end connected to said ground sleeve to extend vertically therefrom, and said screw means is connected to said housing means for turning said screw means into and out of said threaded nut means; and means for controlling said means for turning said screw means.

2. An elevating mailbox as recited in claim 1, wherein the housing and ground sleeve have flat front, back and side walls that are joined at tight angles along common edges; and the mail receiving cavity is an opening formed through the said housing front wall, adjacent to the housing top end, and a transverse plate is secured across said housing interior that aligns with a lower edge of said opening; and a panel is fitted over said opening and connects along a lower edge to one side of a hinge means, with said hinge means opposite side connecting to an edge of said transverse plate at said opening, said hinge means for allowing said panel to pivot from a covering attitude over said opening to approximately a right angle to said housing front wall.

3. An elevating mailbox as recited in claim 2, further including a hand engaging means arranged with said panel to be gripped to pull said panel around its hinge means mounting, and including side walls secured along said panel opposing edges to face into the opening and are to fit therein when said panel is pivoted to close over said opening.

4. An elevating mailbox as recited in claim 1, further including bearing means for connecting a top end of the screw means to the housing.

5. An elevating mailbox as recited in claim 4 wherein the means for turning the screw means is a pulley secured to said screw means and is journaled to an undersurface of a transverse plate that is maintained within the housing, forming the mail receiving cavity thereabove; an electric motor secured within said housing and mounting a pulley across a drive shaft thereof, belt means for fitting around said screw means and motor pulleys; and means for supplying power to and controlling operation of said motor to turn said drive shaft clockwise or counter clockwise.

6. An elevating mailbox as recited in claim 5, further including limit switch means that are maintained to move with said housing, each having a contact arm and is connected electrically to the motor to terminate motor operation upon a limit switch contact with a contact arm, with one contact arm depressed at an upper limit of housing travel, and with another contact arm depressed at a lower limit of housing travel.

7. An elevating mailbox as recited in claim 5, wherein the electric motor is connected through wires to a control panel for programming times for motor operation.

8. An elevating mailbox as recited in claim 1, further including means for closing a space between the housing and ground sleeve against water entering said ground sleeve.

9. An elevating mailbox as recited in claim 8, wherein the means for closing includes forming the cap with an overhang aligned across the housing top end that extends beyond the housing walls; a ground engaging collar mounted to a top end of the ground sleeve that extends outwardly therefrom and is to contact or fit into the surface of the ground wherein the ground sleeve is maintained; and seal means maintained between an undersurface of said cap overhang and said ground engaging collar.

10. An elevating mailbox as recited in claim 9, wherein the seal means is a flat collar for fitting onto the inner edge of the ground engaging collar that has an upturned inner section therearound that the undersurface of the cap overhang engages; and gasket means for fitting between said ground engaging collar surface and said upturned inner section that, when squeezed, expands to contact and seal against the housing walls.

* * * * *